US009305719B2

(12) United States Patent
Pircher et al.

(10) Patent No.: US 9,305,719 B2
(45) Date of Patent: Apr. 5, 2016

(54) SELECTOR FOR A TAP CHANGER

(71) Applicants: Christian Pircher, Lappersdorf (DE); Max Weidinger, Regensburg (DE); Thomas Schuster, Regensburg (DE); Moritz Bengler, Regensburg (DE); Robert Hiltner, Bernhardswald (DE)

(72) Inventors: Christian Pircher, Lappersdorf (DE); Max Weidinger, Regensburg (DE); Thomas Schuster, Regensburg (DE); Moritz Bengler, Regensburg (DE); Robert Hiltner, Bernhardswald (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 0 days.

(21) Appl. No.: 14/385,345

(22) PCT Filed: Apr. 19, 2013

(86) PCT No.: PCT/EP2013/058192
§ 371 (c)(1),
(2) Date: Sep. 15, 2014

(87) PCT Pub. No.: WO2013/164211
PCT Pub. Date: Nov. 7, 2013

(65) Prior Publication Data

US 2015/0060244 A1 Mar. 5, 2015

(30) Foreign Application Priority Data

May 3, 2012 (DE) ..... 10 2012 103 855

(51) Int. Cl.
*H01H 9/00* (2006.01)

(52) U.S. Cl.
CPC ..... *H01H 9/0044* (2013.01); *H01H 9/0016* (2013.01); *H01H 9/0027* (2013.01); *H01H 2009/0022* (2013.01); *H01H 2009/0088* (2013.01)

(58) Field of Classification Search
CPC ..... H01H 9/0016; H01H 9/0027; H01H 2009/0022; H01H 9/0044; H01H 2009/0088
USPC ..... 200/11 TC, 571, 275, 61.54, 504, 11 G; 218/147; 333/107, 262
See application file for complete search history.

(56) References Cited

U.S. PATENT DOCUMENTS 3,798,395 A 3/1974 Norman
4,532,386 A * 7/1985 Muench, Jr. ..... H01H 9/0011 200/11 TC
6,849,813 B1 2/2005 Albrecht
(Continued)

FOREIGN PATENT DOCUMENTS

DE 102010020137 A 11/2011

*Primary Examiner* — Edwin A. Leon
(74) *Attorney, Agent, or Firm* — Andrew Wilford

(57) ABSTRACT

A tap-changer selector for uninterrupted switching between two winding taps of a tapped transformer has fixed contacts arranged circularly in several horizontal planes at a selector housing and a centrally extending rotatable drive shaft in an interior of the selector housing and in each of the horizontal planes of the fixed contacts carries at least one movable contact for connection thereof. The selector housing consists of a plurality of honeycomb segments, and the honeycomb segments are arranged adjacent to one another in the circle in a horizontal plane. A plurality of honeycomb segments arranged in a plane in the circle are arranged vertically one above the other and the honeycomb segments have mounting regions and are so interconnectible by these mounting regions to form when at least two honeycomb segments are connected a mechanically positive connection between at least two mounting regions of the individual honeycomb segments.

10 Claims, 7 Drawing Sheets

(56) References Cited

U.S. PATENT DOCUMENTS 7,649,147 B2 * 1/2010 Xiao ..... H01H 9/0005 200/11 TC
8,013,263 B2 9/2011 Lindsey
8,153,916 B2 * 4/2012 Lindsey ..... H01H 9/0044 200/11 TC
2013/0213776 A1 8/2013 Hoepfl

* cited by examiner

SELECTOR FOR A TAP CHANGER

CROSS REFERENCE TO RELATED APPLICATIONS

This application is the US-national stage of PCT application PCT/EP2013/058192 filed 19 Apr. 2013 and claiming the priority of German patent application 102012103855.4 itself filed 3 May 2012.

FIELD OF THE INVENTION

The invention relates to a selector for a tap changer for uninterrupted switching between winding taps of a tapped transformer.

BACKGROUND OF THE INVENTION

Tap changers have existed in the art in numerous forms for many years. They usually comprise a selector and a load changeover switch.

The selector serves for power-free preselection of the new winding tap that is to be subsequently switched to.

The load changeover switch serves for the actual—rapid—uninterrupted changeover from the previous to the new winding tap preselected while not under load.

A tap changer with a selector is known from the company publication 'OILTAP® M' of the applicant, printing 03/09. In this selector, fixed selector contacts are arranged at an insulating-material frame circularly in a plurality of horizontal planes. These fixed selector contacts are connectable by a drive shaft that is centrally arranged in the interior of the insulating-material frame and that carries at least one movable selector contact in each horizontal plane of the fixed selector contacts. The fixed selector contacts, which are each in electrical connection with a respective winding tap of the associated tapped transformer that is to be regulated, are here thus arranged at and fastened to vertical insulating-material rods. These insulating-material rods can consist of resin-impregnated paper, glass-fiber-reinforced plastic or other insulating material. The insulating-material rods form a frame of vertical, mutually parallel rods; the frame is fixed by an upper ring and a lower ring.

A further tap changer is known from the company publication 'VACUTAP® VV—Laststufenschalter für Regeltransformatoren', printing 05/06, of the applicant. In the case of the selector shown there the fixed selector contacts are again arranged circularly in a plurality of horizontal planes and are connectable by a central drive shaft with movable selector contacts, but the arrangement of the fixed selector contacts is there provided in the wall of a closed insulating-material cylinder. Such an insulating-material cylinder can again consist of resin-impregnated paper, glass fiber-reinforced plastic or other insulating material.

Made known by the further company publication 'VACUTAP®—Laststufenschalter für Ofenanwendungen', printing 09/07, of the applicant is, inter alia, a tap changer of the type VR® in which the selector consists not of a closed insulating-material cylinder, but of a plurality of individual cylinder shells. These cylinder shells form individual segments that in the mounted state de facto form a cylinder contour with corresponding intermediate spaces.

A tap changer with a freewheel element is known from DE 10 2010 007 535 [US 2013/0213776]. The tap changer comprises a switching shaft to which a plurality of mutually parallel actuating elements is fastened. The actuating elements are constructed as cam discs with protrusions.

Mechanical switching elements actuated by way of the protrusions of the cam discs are arranged parallel to the switching shaft. The mechanical switching elements are connected between the selector and the vacuum interrupters of the load changeover switch. Through actuation of the mechanical switching elements the vacuum interrupters in the load branch not conducting load current shall be protected from surge voltages that might arise.

A switch arrangement for a tap changer is known from DE 10 2010 020 137 A1. This tap changer, which serves for voltage-free or current-free switching between winding taps, comprises two integrally constructed fixing elements arranged one above the other in two planes. In addition, the fixing elements have, in the outer annular section, openings for the passage of contact rods. Moreover, each fixing element has a centrally arranged sleeve section in which a switching shaft is mounted. Two respective contact rods are electrically connected together and thus specific winding taps selected, by way of a contact arrangement fastened to the switching shaft.

A tap changer, which consists of a selector and a load switch, for transformers is known from U.S. Pat. No. 3,798,395. In that case the selector serves for power-free preselection of the winding tap and the load switch for rapid switching under voltage. The selector in that regard comprises two rotary contacts that connect each of the taps of the transformer with a respective collector ring and are in that case driven by way of a shaft.

A tap changer with a preselector for uninterrupted switching between different winding taps of a tapped transformer is known from EP 1 105 896 [U.S. Pat. No. 6,849,813]. Preselectors can in general be constructed on the one hand as a coarse tap selector and on the other hand as a reverser. In both cases the regulating range is by this means widened. In other words, multiple use can be made of existing selector contacts. The coarse tap selector realizes this in that a part of the main winding is switched on or switched off. It is possible by the reverser to add the regulating windings to the main winding or, however, to also connect these in opposite sense, thus subtract. A combination of coarse selector and reverser is also possible. As soon as a preselector is used, the actual selector is termed fine selector. In all three cases the preselector is arranged constructionally adjacent to the actual fine selector (selector). Here, too, the constructional realization takes place with the help of cylinder segments or a frame of insulating-material rods to which the movable and fixed preselector contacts are fastened.

The prior art with selectors of that kind for tap changers can thus be summarized as follows: The individual fixed selector contacts are arranged in several horizontal planes circularly around a rotatable drive shaft. The arrangement of the selector contacts and the fixing thereof takes place either at individual rods of insulating material, which form a cage frame, or in the wall of an insulating-material cylinder, or also in the wall of individual insulating-material cylinder segments that when joined together similarly form a circular arrangement.

As explained, the positioning of the fixed selector contacts vertically one above the other—in the case of an insulating-material frame, along the rods as carrier elements—takes place in a plurality of planes. Different subdivisions of the tap changer, i.e. the number of winding taps possibly to be connected and thus the number of fixed selector contacts, are realized by the different number of individual insulating-material rods, the diameter of the insulating-material cylinder or the different number of horizontal planes.

Widening of the regulating range is effected by way of preselectors constructed as coarse selectors, reversers or a combination of the two. These parts similarly consist of insulating-material cylinder segments or insulating-material rods that are arranged adjacent to the fine selector.

Overall, the prior art has various disadvantages. The principal disadvantage is that for different numbers of connectable winding taps of the associated tapped transformer and thus different numbers of fixed selector contacts different constructional forms of the selector are also required.

Due to the electrical voltage stability that has to be maintained the individual fixed selector contacts have to have a specific minimum spacing from one another not only horizontally, but also vertically. A large number of fixed selector contacts in a horizontal plane thus necessarily leads to a large diameter not only of the insulating-material frame, but also of the insulating-material cylinder. Equally, a large number of individual horizontal planes arranged one above the other leads to an increased length of both insulating-material frame and insulating-material cylinder.

In the case of extension of the fine selector (selector) by a preselector, such as, for example, a reverser, the diameter of the overall arrangement is substantially increased. It is also not possible to position this preselector below the fine selector in order to thereby usefully utilize construction space that may be available.

Thus, not only insulating-material rods and the respective fixing rings, but also different insulating-material cylinders in the most diverse dimensions have to be stocked by a manufacturer of tap changers; use of identical parts is thus extremely limited. Overall, this complexity leads to high costs.

Moreover, it is not possible in the production of tap changers to freely select whether a preselector in the form of a coarse selector or a reverser is arranged adjacent to or below the fine selector (selector).

OBJECT OF THE INVENTION

It is the object of the invention to eliminate these disadvantages and to indicate a selector with an optional preselector that is of modular construction and allows reduction of the complexity still with coverage of the same variety, i.e. the range of possible numbers of connectable winding taps.

SUMMARY OF THE INVENTION

This object is fulfilled by a selector of the above-described type, but in which:

the selector housing consists of a plurality of honeycomb segments, the honeycomb segments arranged adjacent to one another in the circle in a horizontal plane, and a plurality of honeycomb segments arranged in a plane in the circle are arranged vertically one above the other and the honeycomb segments have mounting regions and are so interconnectible by way of these mounting regions to form when at least two honeycomb segments are connected a mechanically positive connection between at least two mounting regions of the individual honeycomb segments.

The invention is based on the general idea of constructing a selector according to category in modular form from always uniform, mutually offset honeycomb segments arranged adjacent to one another and one above the other. According to the invention the essential components for such a selector are honeycomb segments that are connected together by way of contacts, contact holders and bolts and in that case surrounded by a screen.

The selector according to the invention offers numerous advantages. In the first instance, only a few different identical parts are required for production thereof. With these, for the same diameter the most diverse lengths and heights of the selector can be realized through construction by means of the honeycomb segments. In other words: The selector according to the invention is, with reduced complexity, adaptable within wide limits to different numbers of winding taps to be regulated and thus required fixed selector contacts.

A further advantage of the invention is that intermediate spaces are left in each horizontal plane between the connecting regions of the honeycomb segments and the contacts arranged there. Since the selector according to the invention is as usual flowed through and around by insulating oil in the transformer vessel, oil paths are realized not only horizontally, but also vertically between all fixed selector contacts; this optimization of insulation paths leads to a high level of voltage stability with a compact construction.

The honeycomb segments additionally make it possible to arrange preselectors either near or below the fine selector in the simplest way and to connect them together. It is thereby possible to flexibly react to given constructional spaces. In addition, use can in that case be made of identical parts.

Through the offset planes of the selector contacts the fine selector can be halved in height by comparison with the prior art. By virtue of the honeycomb structure there are no direct rod paths between the planes, as a result of which the voltage stability is increased.

BRIEF DESCRIPTION OF THE DRAWING

The invention shall be explained in more detail in the following by way of drawings, in which.

SPECIFIC DESCRIPTION OF THE INVENTION

Figure 1:
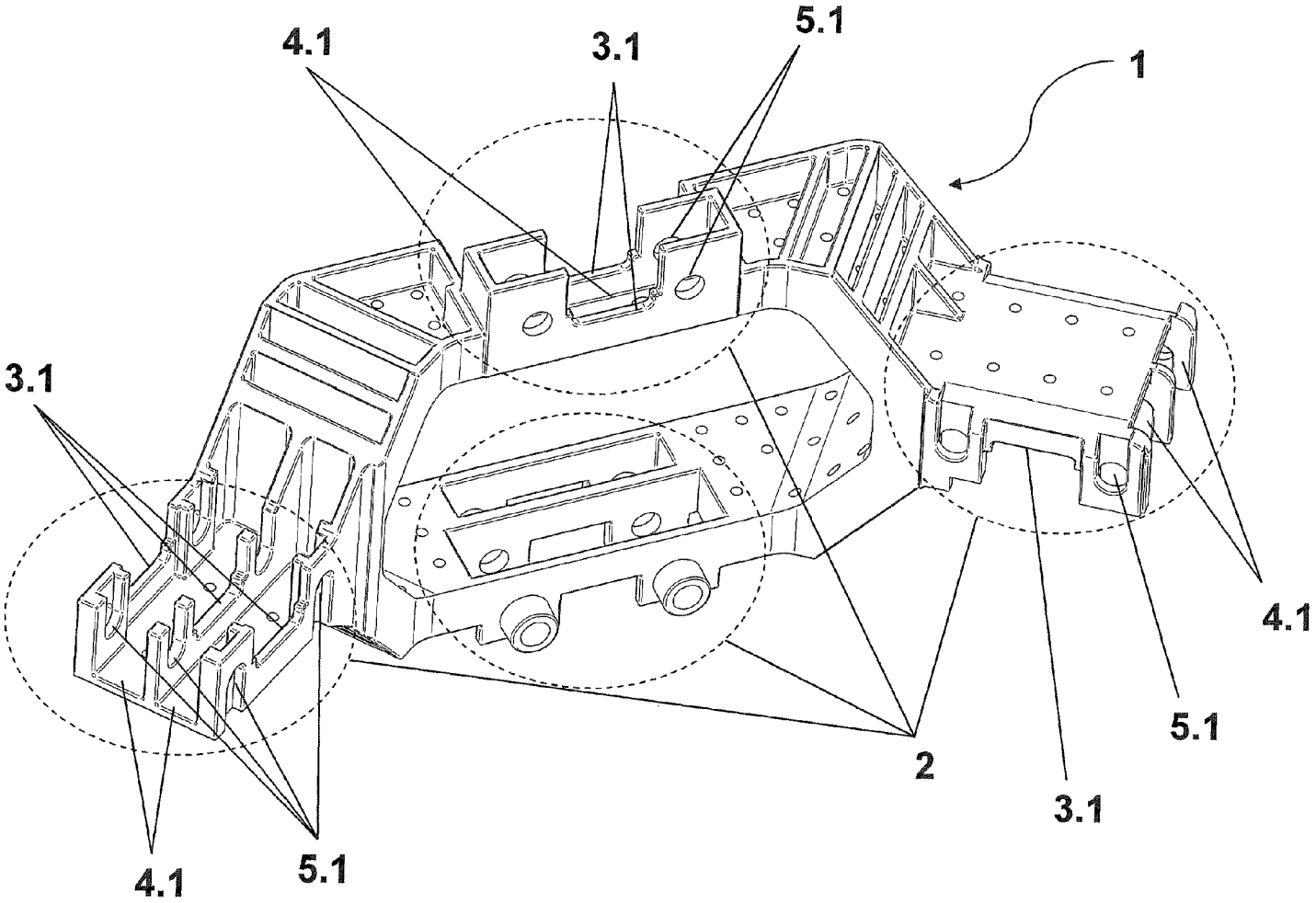
FIG. 1 shows a honeycomb segment according to the invention.

FIG. 1 shows a honeycomb segment 1 according to the invention. This preferably consists of a thermoplastic with a high dielectric strength, such as, for example, PPA. The honeycomb segment 1 has four mounting regions 2 for contacts 3, contact holders 4 and bolts 5. In that case, each mounting region 2 has at least one contact cut-out 3.1 for the contact 3, at least one contact holder cut-out 4.1 for the contact holder 4 and at least one bore 5.1 for the bolt 5. In addition, the contact holder 4 similarly has bores 4.2 corresponding with the bores 5.1 of the honeycomb segments 1.

Figure 2:
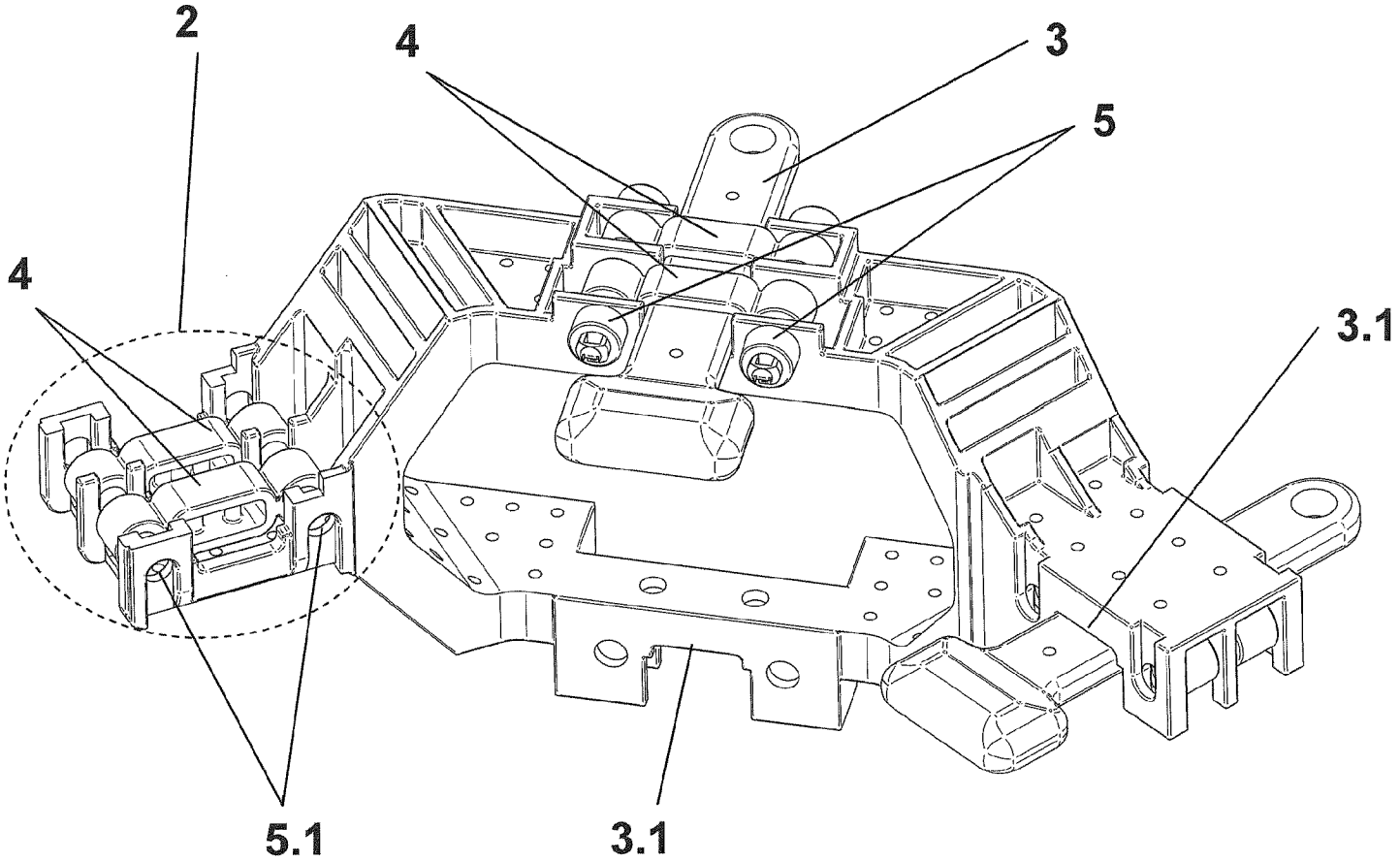
FIG. 2 shows a honeycomb segment according to invention with contacts, contact holders and bolts.

FIG. 2 shows a honeycomb segment 1 in which contact holders 4 are arranged around the contacts 3 in the mounting regions 2. The contact holders 4 can be pushed onto the contacts 3. In addition, it is possible to connect the contact holders 4 directly with the contact 3 by means of an injection-molding method. In order to ensure a firm seat, cut-outs, bores or other geometric structures at the contact can contribute to creation of a mechanically positive connection between contact 3 and contact holder 4 when injection-molded around.

The contact holder 4 also preferably consists of a thermoplastic with a high dielectric strength. The number and thickness of the contact holders 4 can be varied according to requirements.

The contacts 3 and the contact holders 4 fastened thereto can be positioned in the mounting regions 2 by the contact cut-outs 3.1 and the contact holder cut-outs 4.1.

Figure 3:
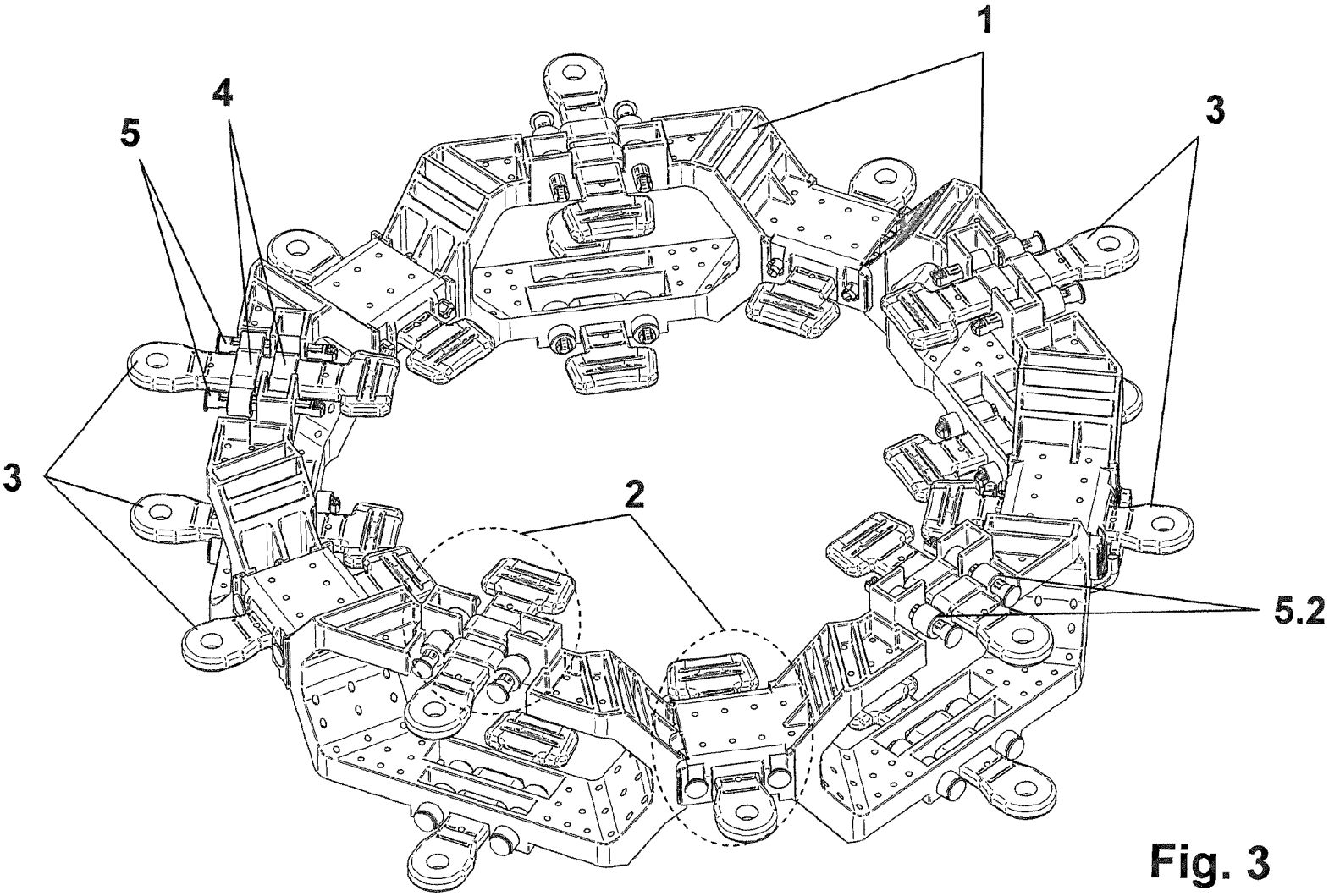
FIG. 3 shows five honeycomb segments connected together.

FIG. 3 shows five interconnected honeycomb segments 1 forming a ring with three planes for possible contacts 3. The two upper contact planes are assigned to one phase and have ten contacts 3. In order to increase the number of contacts 3 to twelve or fourteen only a slight change of the honeycomb segments 1 is required. It is thereby possible, with the same diameter of a selector 7, to connect together more honeycomb segments 1, i.e. in the case of twelve contacts six honeycomb segments 1 and in the case of fourteen contacts 3 seven honeycomb segments 1.

For connecting the honeycomb segments 1 initially the contacts 3 together with the contact holders 4 are inserted into the mounting regions 2. Thereafter, a further honeycomb segment 1 with an empty mounting region 2 is plugged into the mounting region 2, which is equipped with contacts 3 and contact holders 4, of the first honeycomb segment 1. Since the bores 5.1 of the two honeycomb segments 1 correspond with the bores 4.2 of the contact holders 4 all parts can be fixedly connected together with the help of the bolts 5. The bolts 5 are in that case initially guided through the bores 5.1 of the honeycomb segments 1, thereafter through the contact holders 4 and finally again through the bores 5.1 on the other side and locked.

The use of a contact 3 or a contact holder 4 is not absolutely necessary for assembling. Thus, honeycomb segments 1 can be connected merely with the assistance of the bolts 5. This is advantageous when, in the case of high voltages, greater spacings between the individual contacts 3 have to be maintained.

In addition, it can be seen in FIG. 3 that the individual contact planes are offset relative to one another. The dielectric spacing of the individual contacts 3 is then extended, although the height of the selector overall is reduced.

Figure 4:
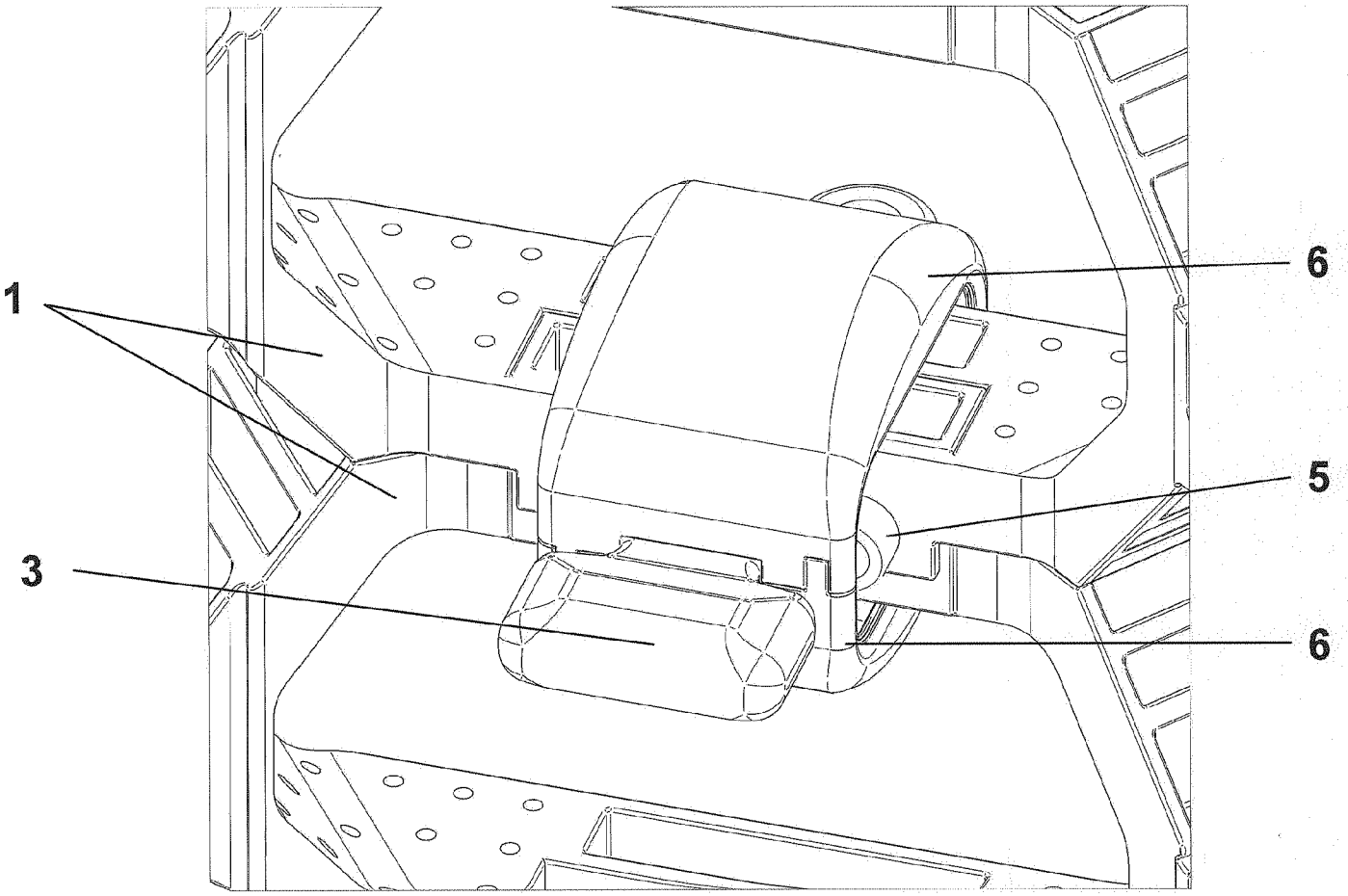
FIG. 4 shows a contact with contact screen.

A contact screen 6, with the help of which voltage stability can be additionally increased, is depicted in FIG. 4. In this form of embodiment this contact screen is of two-part construction. For mounting, the two parts are positioned one above the other and connected together with the help of integrated snap hooks. Other joining methods are also conceivable, for example gluing, screw connections, etc.

Figure 5:
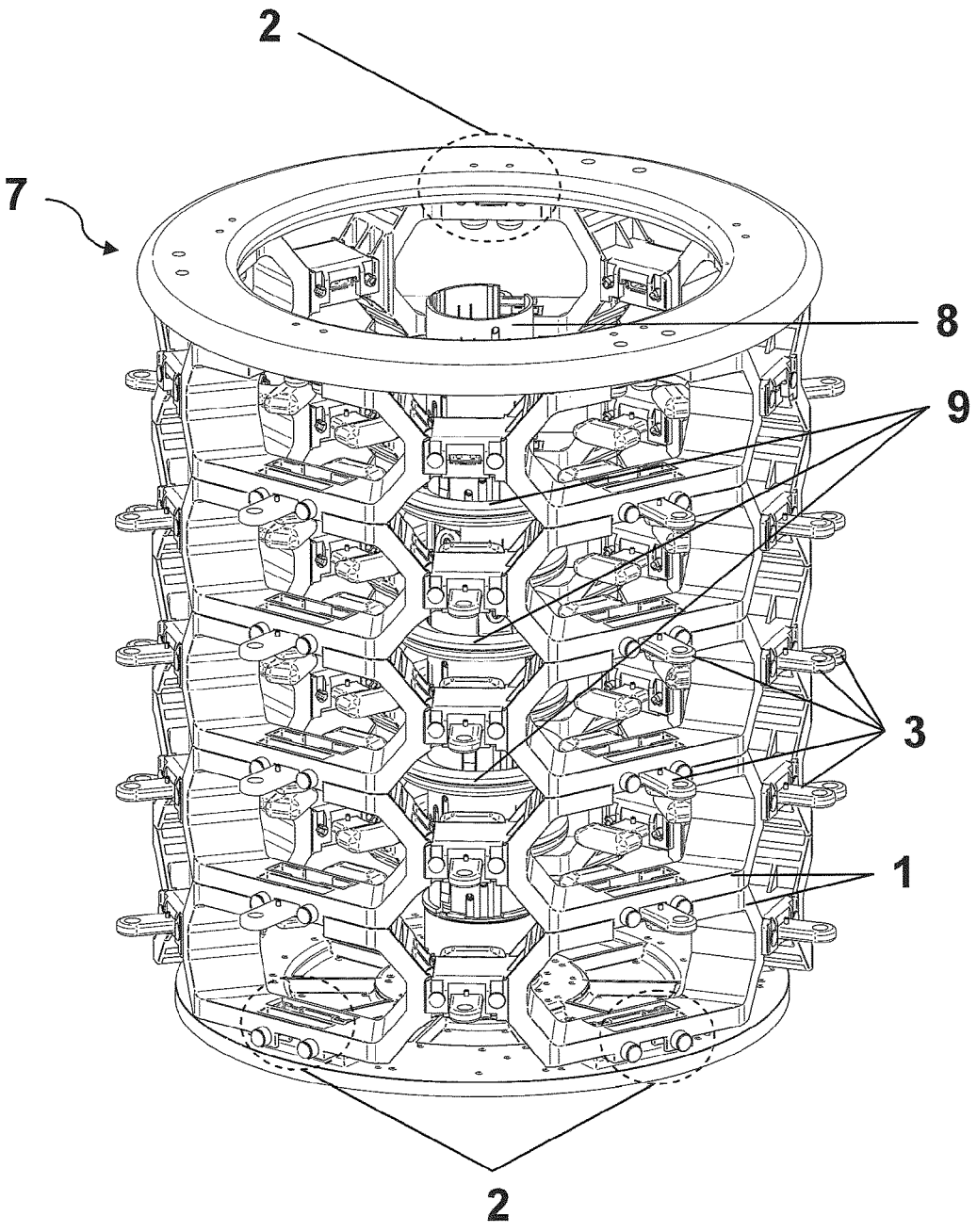
FIG. 5 shows a selector according to the invention.

A selector 7 according to the invention is depicted in assembled state in FIG. 5. This is constructed from a plurality of honeycomb segments 1 placed together at the mounting regions 2. The different contact planes with the different contacts 3 can be clearly seen. Thus, in accordance with the invention and in modular manner a complete selector 7 can be produced with only a few parts. A switching column 8 with diverter rings 9 as well as contact bridges with a drive train (not illustrated here) is depicted in the interior of the selector 7. Interconnected honeycomb segments 1 without contacts 3 can be seen in the upper region of the selector 7.

Figure 6:
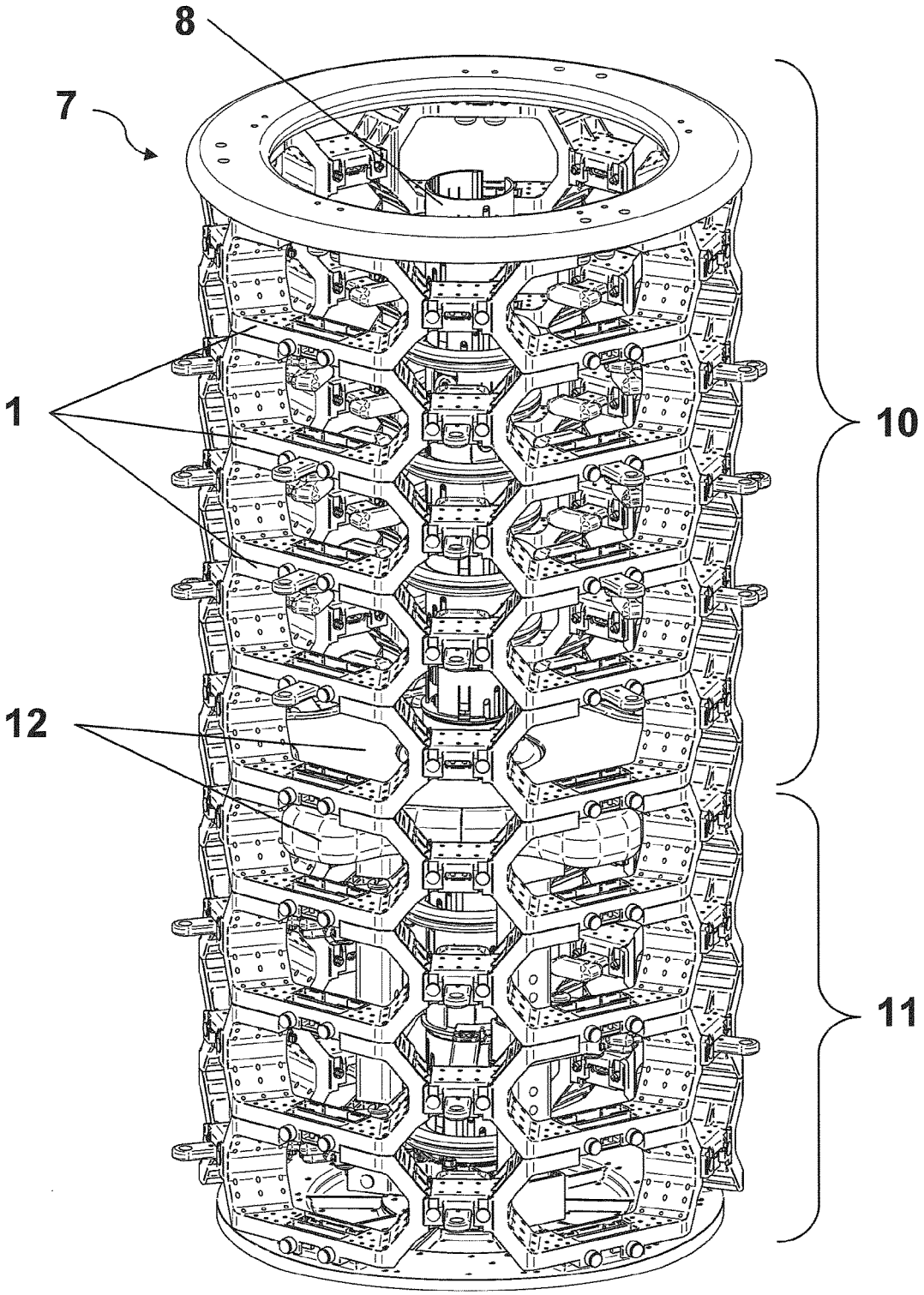
FIG. 6 shows a selector according to the invention with fine selector and preselector arranged one below the other and FIG. 7 shows a selector according to the invention with fine selector and preselector arranged adjacent to one another.

A selector 7 divided into a fine selector 10 and preselector 11 is depicted in FIG. 6. As can be clearly seen, the fine selector 10 and preselector 11 are constructed from identical honeycomb segments 1 that are connected together in always the same manner. An intermediate transmission 12 separates the contact bridges and drive trains present in the interior.

Figure 7:
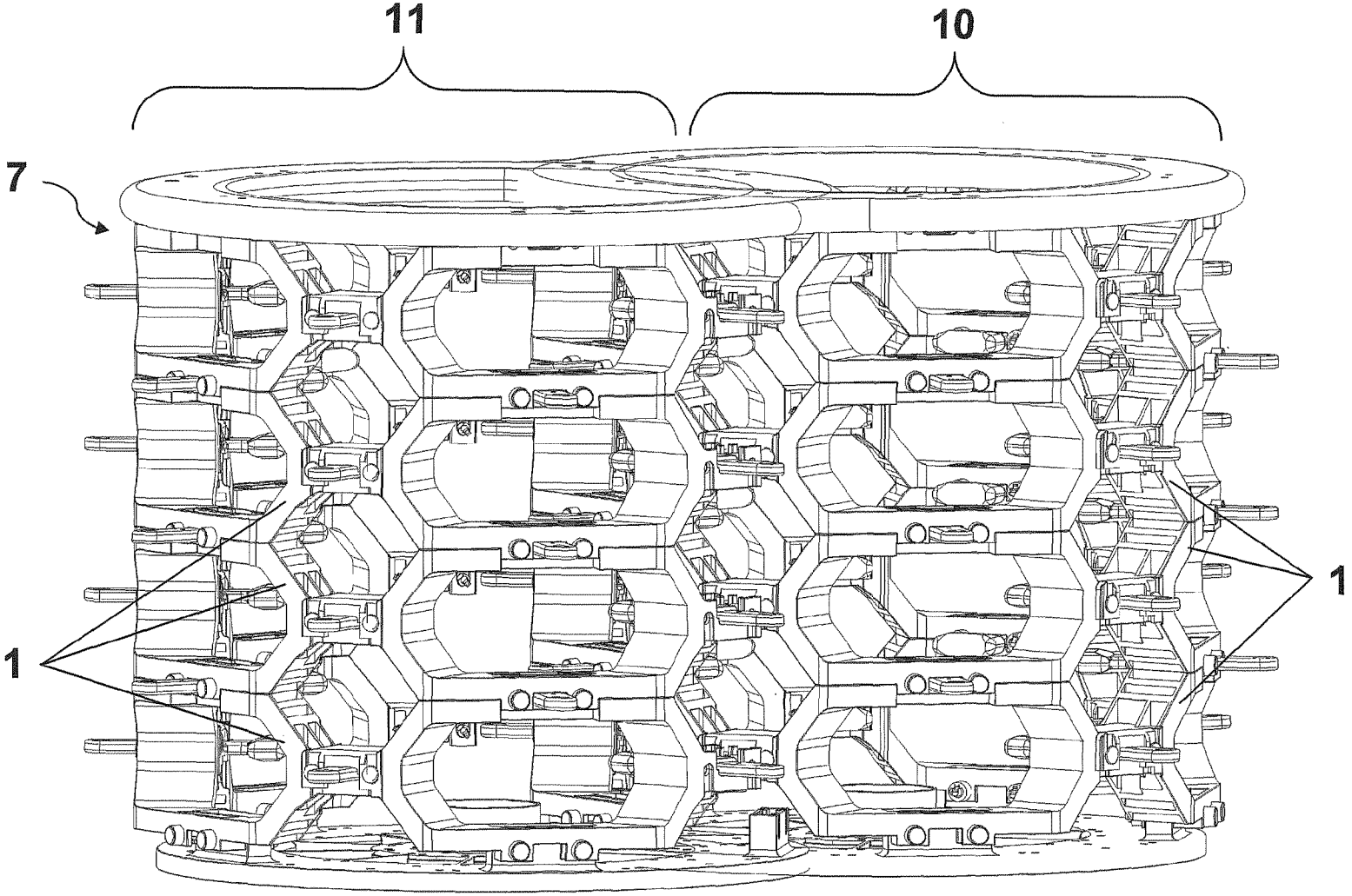

A selector 7 in which fine selector 10 and preselector 11 are arranged alongside one another is depicted in FIG. 7. Here, too, uniform honeycomb segments 1 are always used for both units.

Overall, the invention offers numerous advantages: A selector can be constructed in almost any multiplicity of variants from only a few different components. For assembly, a contact 3 is not absolutely necessary in order to connect the honeycomb segments 1 with one another. The honeycomb structure with its horizontal and vertical intermediate spaces allows particularly good circulation of the surrounding insulating medium, usually insulating oil.

Due to the shape of the honeycomb there are no direct rod paths, i.e. direct connections, between the contact planes as in the prior art. A high voltage stability is ensured, although the constructional height of the fine selector is reduced.

In the case of extensions of the selector by a coarse selector or a reverser use can always be made of identical honeycomb segments. In addition, the free choice of the arrangement of the preselector, namely below the fine selector or alongside, is accompanied by many advantages. Through the offsetting of the selector contact planes of a phase it is possible to reduce the height of the fine selector by a half, wherein dielectric strength is maintained.

In the case of the arrangement of the preselector below the fine selector this can be inserted into or lifted out of the transformer vessel together with the load changeover switch. This is particularly advantageous with respect to assembly and maintenance. During assembly it is no longer necessary to initially install the selector in the transformer vessel and connect it with the load changeover switch only later. The two parts can thus be installed at the same time.

The invention claimed is:

1. In a selector for a tap changer for uninterrupted switching between two winding taps of a tapped transformer, wherein fixed contacts are arranged circularly in several horizontal planes at a selector housing and a centrally extending rotatable drive shaft in an interior of the selector housing and in each of the horizontal planes of the fixed contacts carries at least one movable contact for connection thereof, the improvement wherein the selector housing consists of a plurality of honeycomb segments, the honeycomb segments are arranged adjacent to one another in the circle in a horizontal plane, and a plurality of honeycomb segments arranged in a plane in the circle are arranged vertically one above the other and the honeycomb segments have mounting regions and are so interconnectible by these mounting regions to form when at least two honeycomb segments are connected a mechanically positive connection between at least two mounting regions of the individual honeycomb segments.

2. The selector according to claim 1, wherein the mounting regions each have at least one bore and that when two honeycomb segments are connected at least one bolt for fixing is inserted through the bores.

3. The selector according to claim 2, wherein the mounting regions each have at least one contact holder cut-out, the selector further comprising:

a contact holder with at least one bore, through which the bolt is insertable, and selectably positioned in the contact holder cut-out and a fixed contact at the contact holder.

4. The selector according to claim 1, wherein the selector comprises a fine selector and a preselector.

5. The selector according to claim 4, wherein the fine selector and the preselector are vertically one above the other or horizontally adjacent to one another.

6. The selector according to claim 4, wherein the preselector is a reverser or coarse tap selector.

7. The selector according to claim 4, further comprising:

an intermediate transmission separating the fine selector and the preselector from one another in the interior.

8. The selector according to claim 1, wherein the selector comprises five, six or seven honeycomb segments per phase.

9. The selector according to claim 3, further comprising:

a contact screen around the contacts.

10. The selector according to claim 1, wherein the honeycomb segments each consist of PPA.

* * * * *